US007807020B2

(12) United States Patent
Gommel et al.

(10) Patent No.: US 7,807,020 B2
(45) Date of Patent: Oct. 5, 2010

(54) METHOD FOR DEGASSING AND SUPPLYING A FIBROUS SUSPENSION TO A HEADBOX OR A FILTER DEVICE AND DEGASSING DEVICE

(75) Inventors: Axel Gommel, Ravensburg (DE); Erwin Binder, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 609 days.

(21) Appl. No.: 11/574,634

(22) PCT Filed: Sep. 20, 2005

(86) PCT No.: PCT/EP2005/010094

§ 371 (c)(1),
(2), (4) Date: Mar. 2, 2007

(87) PCT Pub. No.: WO2006/045378

PCT Pub. Date: May 4, 2006

(65) Prior Publication Data

US 2007/0267156 A1 Nov. 22, 2007

(30) Foreign Application Priority Data

Oct. 21, 2004 (DE) ..... 10 2004 051 327

(51) Int. Cl.
*D21C 5/00* (2006.01)

(52) U.S. Cl. ..... 162/55; 162/58; 162/380; 95/243; 95/241

(58) Field of Classification Search ..... 162/58, 162/55, 380, 190; 95/243, 241
See application file for complete search history.

(56) References Cited

U.S. PATENT DOCUMENTS

| | | | |
|---|---|---|---|
| 5,861,052 | A | 1/1999 | Meinander |
| 6,723,205 | B1 | 4/2004 | Meinander |

FOREIGN PATENT DOCUMENTS

| | | |
|---|---|---|
| DE | 19938799 | 2/2001 |
| EP | 1050342 | 6/2006 |
| WO | 92/03613 | 3/1992 |
| WO | 96/19276 | 6/1996 |

*Primary Examiner*—Mark Halpern
(74) *Attorney, Agent, or Firm*—Greenblum & Bernstein, P.L.C.

(57) ABSTRACT

The invention relates to feeding a fibrous suspension to a headbox of a paper or cardboard machine, or to a filter device. The method includes: diluting a high-consistency suspension with a liquid to form a fibrous suspension; degassing the fibrous suspension via a degassing device having a rotating rotor, which is structured to apply centrifugal forces to the fibrous suspension; and guiding a degassed diluting liquid out of the degassing device.

15 Claims, 5 Drawing Sheets

METHOD FOR DEGASSING AND SUPPLYING A FIBROUS SUSPENSION TO A HEADBOX OR A FILTER DEVICE AND DEGASSING DEVICE

CROSS-REFERENCE TO RELATED APPLICATIONS

The present application is a U.S. National Stage of International Patent Application No. PCT/EP2005/010094 filed Sep. 20, 2005, and claims priority of German Patent Application No. 10 2004 051 327.9 filed Oct. 21, 2004.

BACKGROUND OF THE INVENTION

1. Field of the Invention

The invention relates to a method for feeding a fibrous suspension and, in particular, to feeding a fibrous suspension to a headbox of a paper or cardboard machine or to feeding a fibrous suspension to at least one filter device and degassing device. The invention also relates to a degassing device for carrying out the above noted methods.

2. Discussion of Background Information

Methods of this type are used, for example, to supply paper or cardboard machines with fibrous suspension. The headbox delivers a fibrous layer onto a passing screen that has a thickening function. The stock feeding systems required thereto are known in principle. The fibrous suspension, which is to be fed, receives a major part of the fibers from a high-consistency suspension provided in a stock preparation unit. The high-consistency suspension has, e.g., a typical consistency between 2.5 and 5%. However, with the addition of a diluting liquid, such as a paper machine's backwater, the consistency of the high-consistency suspension is lowered to a value that is favorable for operating the headbox of the paper machine. While the backwater is optimally suited for this diluting task, there are problems due to the high gas content when the predominant part is air. The largest proportion of these gases escape very quickly, however, the residual gases often have to be removed in a complex manner so that the quality of the paper produced is not unduly lowered. Known solutions are large degassing containers in which negative pressure is permanently maintained by evacuation, wherein the negative pressure corresponds to the steam pressure of the suspension to be degassed. This is effective, but expensive.

A degassing pump for paper production is known from U.S. Pat. No. 6,723,205 B1, wherein the pump is provided with a rotor forming a cylindrical interior, in which the fed liquid can be degassed by centrifugal force. The backwater fed from the paper machine at high speeds provides the drive power for the rotor via a turbine, which is integrated into the degassing pump. When the backwater has left the degassing pump, the liquid is guided directly to a mixing station where raw fiber material (high-consistency stock) is added.

Another application for methods of this type occurs in the preparation unit ("stock preparation"), where the fibrous suspension is designated for processing on the paper or cardboard machine. Filter devices, and in particular disk filters, are used to increase the consistency of suspensions with relatively low consistency, e.g., between 0.5% and 1.5%. The fibrous suspension to be thickened can thereby have a high percentage of air content. For example, a high air content may exist if the fibrous suspension had previously been floated to eliminate contaminants with the flotation foam. The operation of disk filters and pumps is adversely affected by higher air contents.

SUMMARY OF THE INVENTION

An aspect of the invention is to create a method of the type mentioned at the outset, wherein the stock flow is guided to the headbox or to a filter device and the stock flow is sufficiently degassed. Relatively little expenditure is required for the method to operate reliably.

To attain this aspect a method is provided. The method is directed to feeding a fibrous suspension to at least one headbox of a paper or cardboard machine with at least one diluting device, in which the fibrous suspension is generated by mixing a high-consistency suspension with a diluting liquid such as water. The method utilizes at least one device for removing gas from liquid, and includes guiding a fibrous suspension into the at least one degassing device after mixing it with a diluting liquid. The degassing device reaches the interior of a rotating rotor and is put into rotation, so that the gases contained are eliminated because of centrifugal forces. The degassed diluting liquid is guided out of the degassing device into a separate stock pump.

A further aspect of the invention includes guiding diluting liquid into at least one degassing device before being mixed with a high-consistency suspension. The degassing device reaches the interior of a rotating rotor and is put into rotation so that the contained gases are eliminated because of centrifugal forces. The degassed diluting liquid is guided out of the degassing device into a separate diluting water pump.

Further, a method is provided for feeding a fibrous suspension to at least one filter device, preferably a disk filter, is structured to allow the fibrous suspension to be thickened through a filter process. The fibrous suspension has a maximum consistency of 4%, and preferably between 0.5 and 2%. According to the method, the fibrous suspension is guided into at least one degassing device before thickening and the fibrous suspension reaches the interior of a rotating rotor and is put into rotation so that contained gases are eliminated because of centrifugal forces.

Moreover, a degassing device is provided for carrying out at least one of the above methods, which includes a housing in which a rotor having an interior is arranged in a rotatable manner. The degassing device comprises an inlet for adding a liquid to be degassed that opens into the interior of the rotor, an outflow preferably mounted tangentially for the degassed liquid, and a centrally arranged degassing tube to which a vacuum device for removing the gas escaping from the liquid is connected. The rotor is provided with at least one opening, through which a hydraulic connection with the outflow is produced, characterized in that the rotor is connected to a motor that drives it.

The stock feeding system according to the invention is characterized in particular in that a degassing device is used for the degassing of the backwater or the fibrous suspension, wherein the degassing device is constructed in a compact manner and still permits for a good degassing. In particular the stock feeding system is generally not required to use large complex containers that greatly strain the building during operation because of their high weight. Containers of this type are operated with the suspension steam pressure degassed and are thus under extreme negative pressure due to the strength requirements resulting therefrom. Vacuum systems with high energy consumption are not required for the method according to the invention.

The method is used in a particularly favorable manner with paper machines having a screen speed between 800 and 1600 m/min. The amount of air contained in the backwater is highly dependent on the screen speed.

The method can also be used if the fibrous suspension is guided via a disk filter for thickening—as is known per se. A disk filter of this type permits a considerably higher flow rate if the air content of the liquid flowing in is lowered.

Another essential advantage of the invention, apart from the fact that the stock pump connected to the degassing device ensures further transport of the deaerated fiber suspension after leaving the degassing container, is that a lower pressure can be set in the degassing device to promote the degassing as the pump exerts a suction.

BRIEF DESCRIPTION OF THE DRAWINGS

In an advantageous embodiment the rotor of the degassing device is driven by a motor, e.g., an electric motor. The peripheral speed of the rotor is thus easy to set to a value corresponding to the requirements.

The invention is explained on the basis of drawings. They show.

DETAILED DESCRIPTION OF THE PRESENT INVENTION

Figure 1:
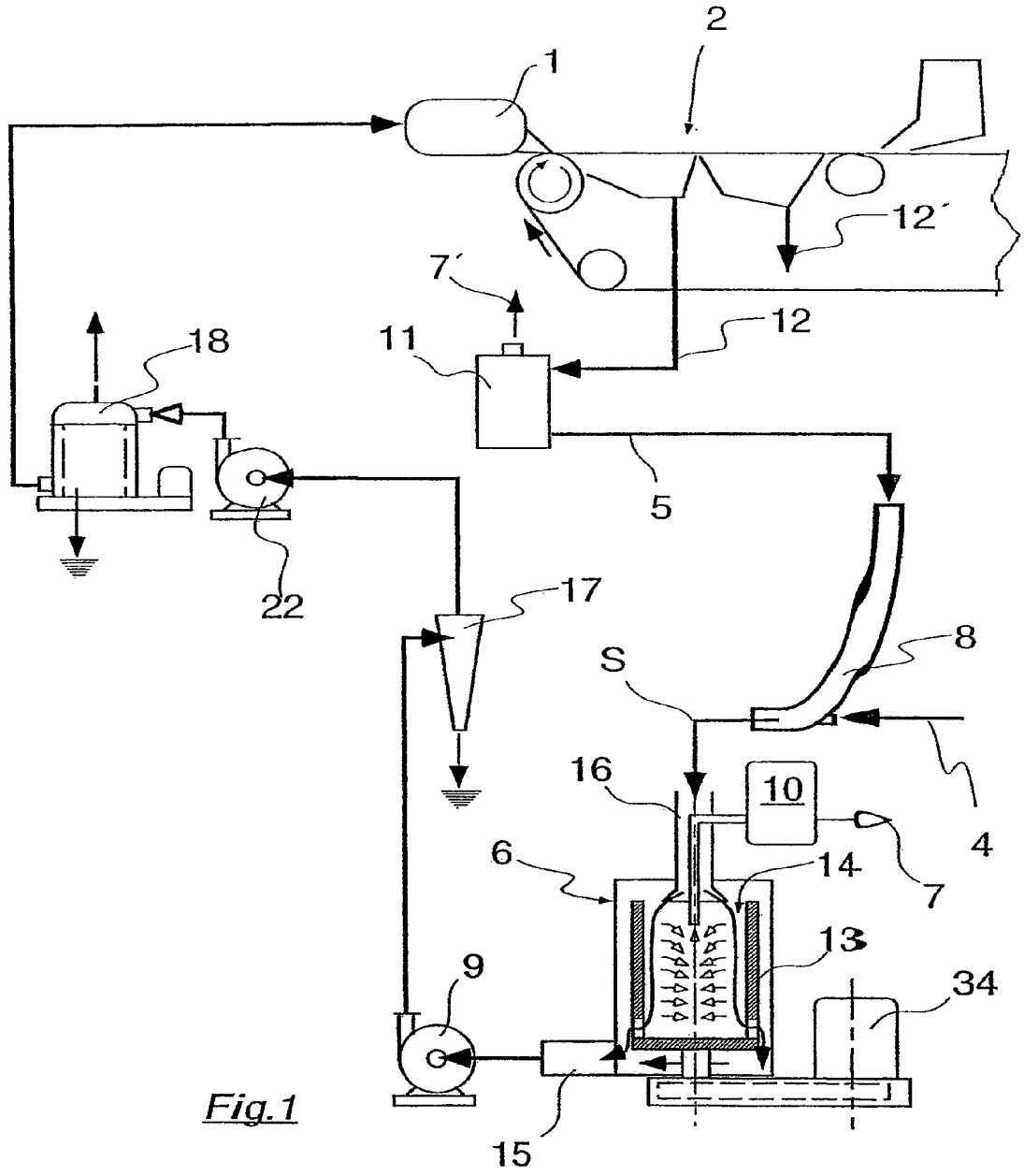
FIG. 1 A simplified diagram of the method.

The diagram of FIG. 1 shows a first example for carrying out the method according to the invention. A fibrous suspension S is generated in the customary manner by mixing a high-consistency suspension 4 with a diluting liquid 5, thereby resulting essentially in a consistency desired at this point for the operation of the headbox 1 of the paper or cardboard machine 2. As is known, headbox consistencies are in the range between 0.5 and 2%, and generally around 1%. In the example shown here, the diluting liquid 5 fed at a mixing site 8 comes from the first backwater 12, i.e., the water accumulated in the forming area of the paper or cardboard machine 2. It is often referred to as backwater I (SW I), as opposed to the second backwater 12' (SW II), which accumulates on the paper machine at a later point and contains far fewer fines.

It is known that backwater of this type is mixed with a considerable proportion of air and potentially with other gases. The backwater is caught below the paper machine screen and drained off at the side. A large part of the contained air can escape in the open channels used, however, it is often expedient to eliminate a further gas proportion 7' in a special container 11, as is known, e.g., from DE 199 38 799. As a supporting measure, the container 11 can be under a moderate negative pressure. After the high-consistency suspension 4 and the diluting liquid 5 have been mixed, a degassing device 6 is used. This is constructed as a cylindrical or conical container and provided according to the invention with a rotor 13. The rotor 13 is driven by a motor 34, e.g. an electric motor, which is not powered from the hydraulic energy of the degassed suspension flow. The fibrous suspension S reaches the essentially cylindrical interior 14 of the rotor 13 and is put into rapid rotation. This principle corresponds to that of a solid bowl centrifuge. As a result of the centrifugal forces, the contained gases 7 move inward and are suctioned off from the center by a vacuum device 10 (merely indicated roughly). A liquid/gaseous phase boundary thereby forms in the container. The centrifugal forces can be at least 5 times, and preferably 10 times the acceleration of gravity. The vacuum device 10 requires no negative pressure and corresponds to, or is similar to, the steam pressure of the suspension. Values customary for the vacuum device's 10 negative pressure used here are approximately 0.8 to 0.9 bar.

Figure 2:
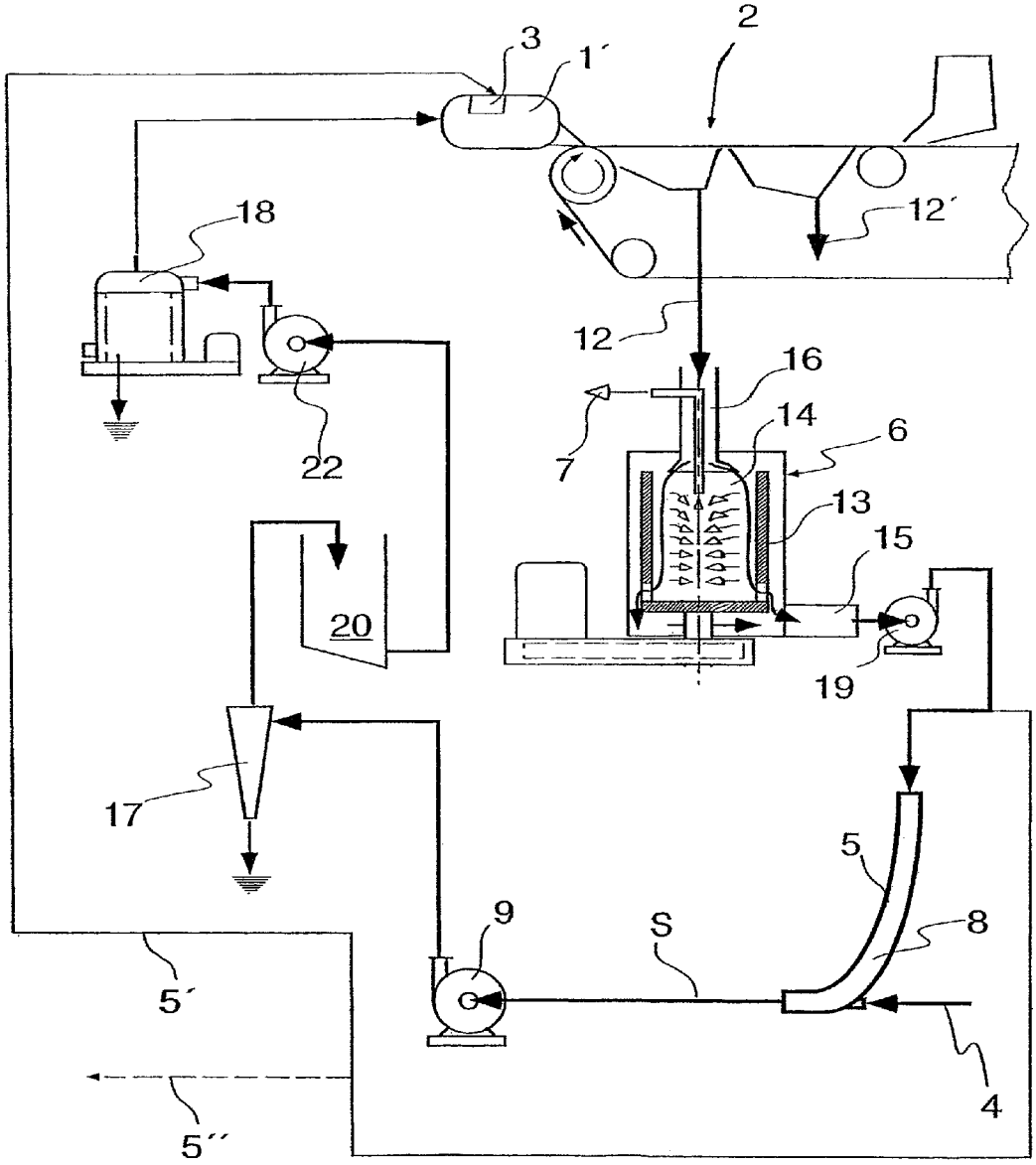
FIG. 2 A variation of the method.

After leaving the degassing device 6, the suspension is guided via a stock pump 9 to the headbox 1—as shown here in a closed system (i.e., without any open containers or vats). In a customary manner, the remainder of the contaminants still present is thereby eliminated by a cleaner unit 17 and a screening unit 18. In order to prevent the pressure in the cleaner unit 17 from becoming too high, a pump 22 ("booster pump") can be installed to increase the pressure between the cleaner unit 17 and intake at the screening unit 18. Alternatively, an open intermediate vat 20 can also be provided for the stock guidance after the stock pump 9, e.g., in order to reduce pulsations. This is shown in FIG. 2, but can also be realized in a unit according to FIG. 1. The expenditure necessary for these hydrocyclones and screens will naturally depend on the raw materials and the demands on the quality of the paper produced. For example, if the high-consistency suspension 4 was generated from recovered paper, then sand and small plastic parts may still be present.

The invention can also be embodied such that, as shown in FIG. 2, the backwater 12 of the paper or cardboard machine 2 is degassed in a degassing device 6, the function of which corresponds to the degassing device described in connection with FIG. 1. The degassed backwater is guided through the outlet 15 directly into a diluting water pump 19. The degassing can be carried out much more easily because of the considerably lower proportion of solids in the backwater 12 as compared to the fibrous suspension S. However, in order to prevent any losses in terms of quality, this requires at most a low gas content in the high-consistency suspension 4 added at the mixing site 8.

As is known, there are many paper or cardboard machines in which the headbox is supplied not only with the fibrous suspension S, as already mentioned, but also with a diluting liquid which is added in a metered manner at various points over the width of the headbox 1. It is thus possible, for example, to influence and in particular to optimize, the cross profile of the fibrous layer formed with the headbox. FIG. 2 shows an option of this type, wherein the backwater is also used as diluting liquid 5 for the high-consistency suspension 4. A part of the backwater deaerated in the degassing device 6 is guided as a diluting liquid 5' into a metering device 3 of the headbox 1' by way of the diluting water pump 19, wherein the metering device subdivides it and adds it a metered manner to the fibrous suspension S at various points. In a paper mill there are often further points at which further diluting liquid 5" deaerated by the method can be used, which is indicated here by a dashed arrow.

Figure 3:
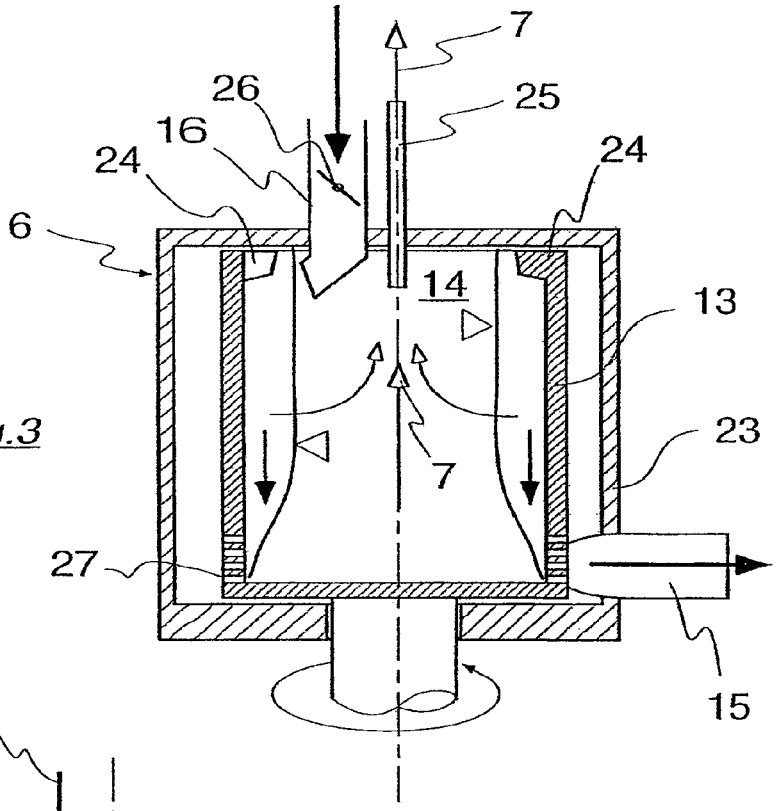
FIG. 3 A degassing device according to the invention.

Without showing constructive details, FIG. 3 shows a sectional view of a degassing device 6 suitable for the method. A rotor 13 is arranged in a stationary housing 23, wherein the interior 14 of the rotor is supplied with a liquid to be degassed through the inlet 16. The inlet 16 can be arranged centrally or, as here, eccentrically. The liquid added through the inlet 16 is first greatly accelerated in the circumferential direction, which can use, e.g., acceleration ribs 24. As a result of the centrifugal forces the liquid bears against the interior wall of the rotor 13, whereby the gas contained therein, in particular the air, moves toward the center of the rotor 13. As a rule, a discontinuity surface forms between the liquid and the gas 7. The gas 7 can be discharged or suctioned off through a central degassing tube 25. With a continuous operation of this degassing device, the operating conditions can be controlled, e.g., by way of an input throttle 26, such that an uninterrupted liquid flow forms from the inlet 16 to the outflow 15. In the area of the outflow 15, the wall of the rotor 13 is accordingly embodied to be permeable to liquids. This may be done, for example, by placing openings 27 in the area of the outflow 15. Advantageously, the outflow 15 is mounted tangentially such that the rotational flow of the degassed liquid causes a pressure build-up in the outflow 15. The openings 27 in the wall of the rotor 13 are so big that they do not lead to a screening of the degassed liquid.

Figure 4:
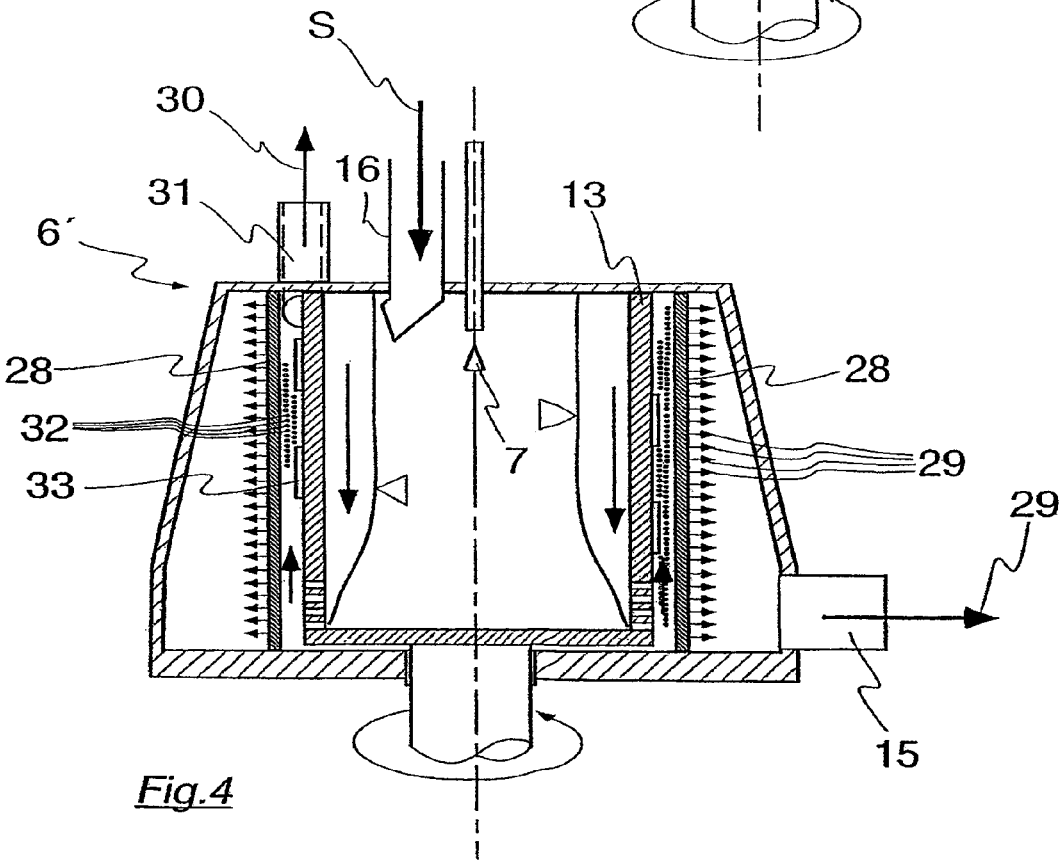
FIG. 4 A degassing device according to the invention with screening function.

The embodiment of a degassing device 6' shown in FIG. 4 combines the function of degassing with the function of screening. As already mentioned, the last screening stage is often placed upstream from the headbox when supplying a paper machine to prevent contaminants from getting into the headbox, which interfere with the operation of the headbox or the paper machine. This screening function can be carried out in combination with the degassing function in the same device. To this end, a screen basket 28 is arranged such that the degassed liquid flows radially outward from the rotor 13 and is fed to the screen basket 28. In a manner known per se, a separation into accepts 29 and rejects 30 occurs at the screen openings 32 of the screen basket 28. The rejects can be drained off out of the device through a reject outflow 31. By way of example and not to scale, only some of the screen openings 32 in the screen basket 28 are drawn. The combination has the advantage that the rotor 13 can also serve to keep the screen openings 32 clear. To this end, clearing elements 33 are mounted on its outside, which are capable of generating suitable suction and pressure impulses in the fiber suspension.

Figure 5:
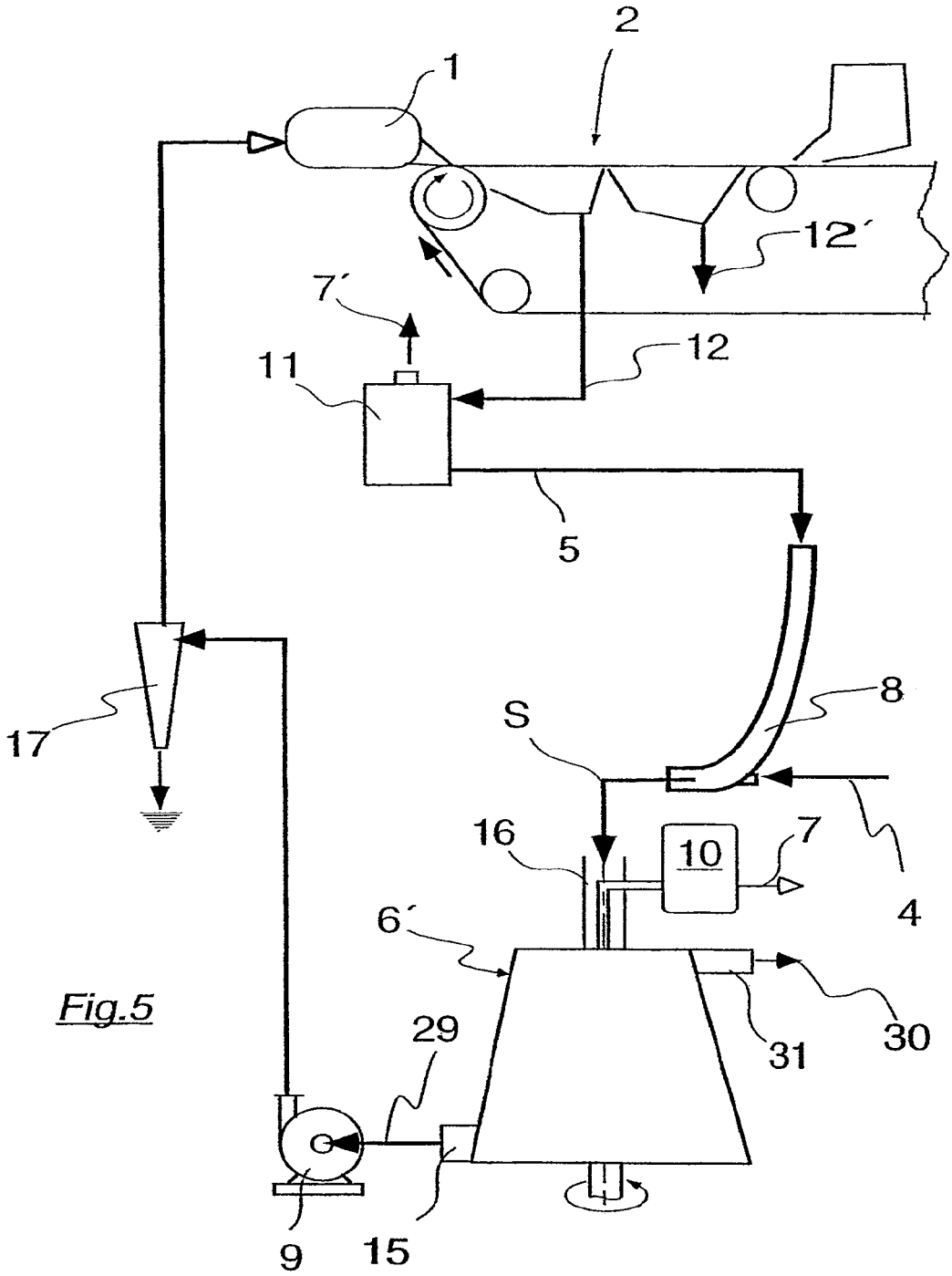
FIG. 5 Another embodiment of the method.

FIG. 5 shows a diagram of the method using a degassing device 6' embodied according to FIG. 4. The screens shown in FIG. 1 for the fibrous suspension S can then be omitted. A cleaner unit 17 may possibly still be necessary between the degassing device 6' and the headbox 1 depending on the contaminants present in the fibrous suspension S.

Figure 6:
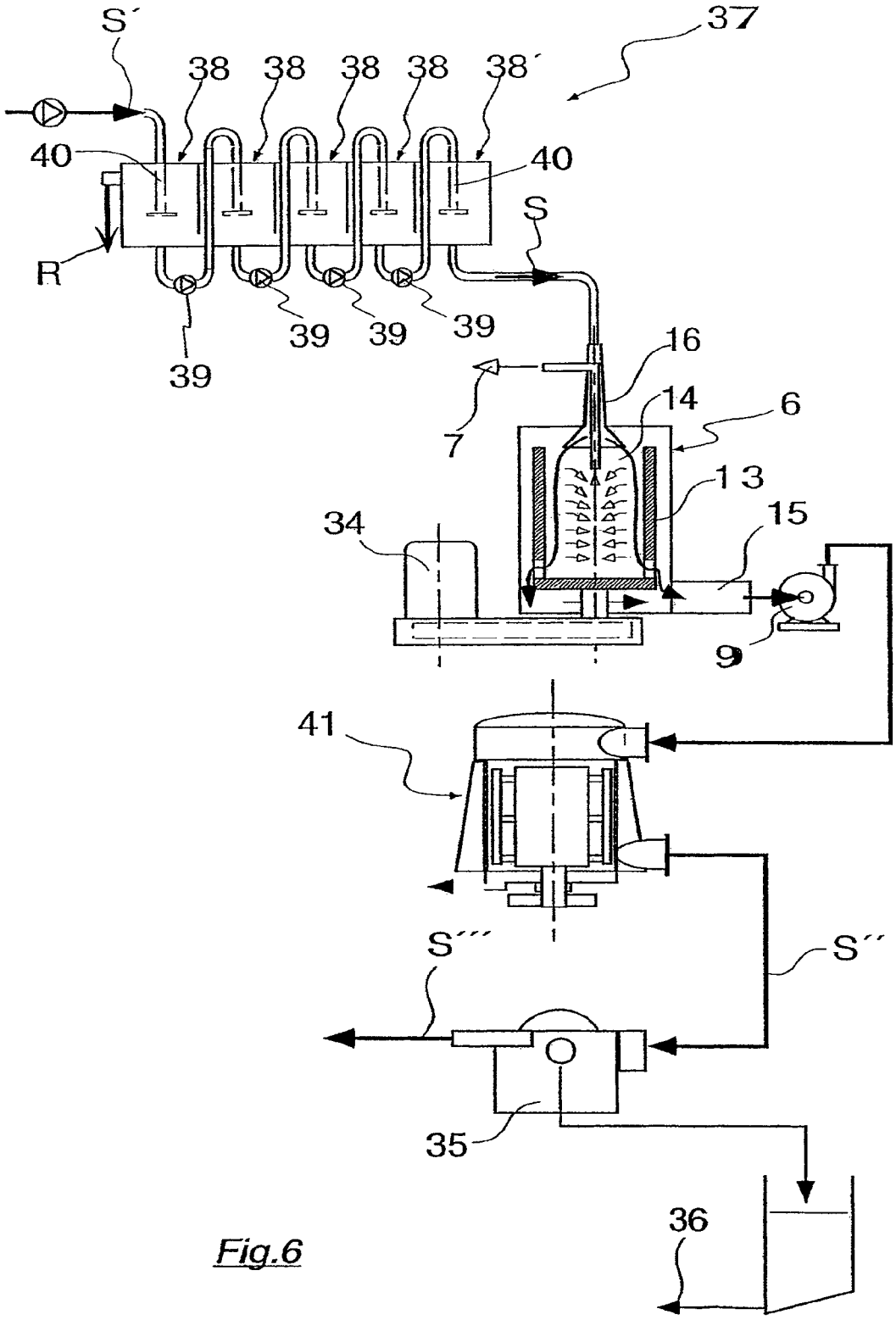
FIG. 6 An application of the method in stock preparation.

FIG. 6 shows a favorable application of the invention in the stock preparation of a paper mill. A low-consistency fibrous suspension S" is thickened in a disk filter 35 (only indicated) and is thereby brought to a higher consistency. The stock S'" thickened by the filter effect can be further treated as a raw material for paper production, whereas the filtrate 36 serves, e.g., for diluting. The reason for a measure of this type is that the steps in the stock preparation method proceed optimally with partly low and partly high consistency.

In the unit shown in FIG. 6 a flotation unit 37 is operated which cleans a fibrous suspension S' mixed with contaminants, e.g., printing ink particles, at low consistencies such as between 0.5 and 2%. Five flotation cells 38 of floatation unit 37 are diagrammatically shown flowing through one after the other. The accepts of an upstream flotation cell are respectively conveyed into the next flotation cell via a ventilation injector 40 by way of several pumps 39. The rejects R formed, i.e., the flotation foam, contain the eliminated contaminants. The accepts of the last flotation cell 38' with an air content of, e.g., between 3% and 6%, are extracted by a stock pump 9 downstream of the degassing device 6. This lowers the pressure of the degassing device 6, which further benefits the degassing effect.

The degassing device 6 inserted between the flotation unit 37 and the disk filter 35 removes a large part of the air absorbed, e.g., in the flotation unit 37. The disk filter 35 already allows 10% more throughput, e.g., with a reduction of the air content by one percentage point. If there is, e.g., a reduction from 6% to 1%, the possible throughput is approximately 50% higher. Other problems connected to a relatively high air content, e.g., at the stock pump 9, are also eliminated effectively and economically. The degassing device 6 described is particularly economical especially for objects of this type, in which the last fractional percentage amount of the air content in the degassed liquid is not relevant.

A fine screening 41 is often carried out after the flotation and before the thickening, wherein the fine screening is particularly effective with low consistencies (e.g., 0.5 to 2%).

The invention claimed is:

1. A method for feeding a fibrous suspension to at least one headbox, comprising:

diluting a high-consistency suspension with a liquid to form a fibrous suspension;

degassing the fibrous suspension via rotation of a rotor of a degassing device to apply centrifugal forces to the fibrous suspension to form a degassed liquid; and guiding the degassed liquid from the degassing device to a separate stock pump.

2. The method of claim 1, wherein the liquid is water.

3. The method of claim 1, further comprising guiding the degassed liquid to a headbox via the stock pump.

4. The method of claim 3, wherein the degassing device is arranged directly before, with regard to a flow direction of the fibrous suspension, the stock pump.

5. The method of claim 1, further comprising wet screening the fibrous suspension in the degassing device to remove contaminants from the fibrous suspension by guiding the degassed diluting liquid out of an interior of the degassing device to a screen basket.

6. The method of claim 5, wherein the screen basket is built into the degassing device.

7. The method of claim 5, wherein the rotor is structured to keep the screen basket clear.

8. The method of claim 5, wherein the screen basket is arranged radially outside the rotor.

9. The method of claim 1, wherein the diluting liquid comprises backwater from a paper or cardboard machine.

10. The method of claim 9, further comprising at least partly degassing the backwater in open channels before degassing in the degassing device.

11. The method of claim 9, further comprising guiding the fibrous suspension to a headbox with a stock pump, wherein the fibrous suspension is not degassed by a negative pressure applied by the stock pump.

12. The method of claim 11, wherein the fibrous suspension is guided to the headbox in a closed system.

13. The method of claim 1, further comprising guiding the fibrous suspension through a cleaner unit located after the degassing device, relative to a fibrous suspension flow direction, with a stock pump, wherein accepts of the cleaner unit are not degassed by a negative pressure applied by the stock pump.

14. The method of claim 13, wherein the stock pump is arranged directly downstream from the degassing device.

15. The method of claim 1, wherein the fibrous suspension is fed from the at least one headbox to a screen moving at a screen speed between 800 and 1600 m/min.

* * * * *